US008887835B2

(12) United States Patent
Kosovich

(10) Patent No.: US 8,887,835 B2
(45) Date of Patent: Nov. 18, 2014

(54) DRILLING APPARATUS

(75) Inventor: John Kosovich, Auckland (NZ)

(73) Assignee: JFK Equipment Limited, Kaitaia (NZ)

( * ) Notice: Subject to any disclaimer, the term of this patent is extended or adjusted under 35 U.S.C. 154(b) by 604 days.

(21) Appl. No.: 13/048,243

(22) Filed: Mar. 15, 2011

(65) Prior Publication Data

US 2012/0061142 A1 Mar. 15, 2012

Related U.S. Application Data

(63) Continuation-in-part of application No. PCT/NZ2009/000197, filed on Sep. 17, 2009.

(30) Foreign Application Priority Data

Sep. 17, 2008 (AU) ..... 2008904823

(51) Int. Cl.
*E21B 4/14* (2006.01)
*E21B 17/06* (2006.01)

(52) U.S. Cl.
CPC ..... *E21B 4/14* (2013.01)
USPC ..... 175/296; 175/293; 175/294; 166/242.6; 173/91

(58) Field of Classification Search
USPC ..... 166/242.6; 175/294, 296, 293; 173/91, 173/206–208
See application file for complete search history.

(56) References Cited

U.S. PATENT DOCUMENTS

| | | | | |
|---|---|---|---|---|
| 4,828,048 | A | 5/1989 | Mayer et al. | |
| 5,092,411 | A | 3/1992 | Hausherr et al. | |
| 5,375,670 | A | 12/1994 | Ekwall et al. | |
| 5,823,274 | A * | 10/1998 | Wisakanto et al. | 175/215 |

FOREIGN PATENT DOCUMENTS

| | | |
|---|---|---|
| EP | 0233038 | 8/1987 |
| JP | 6313391 | 11/1994 |
| WO | 96/08632 | 3/1996 |
| WO | WO 96/20330 | 7/1996 |

* cited by examiner

*Primary Examiner* — Giovanna Wright
*Assistant Examiner* — Wei Wang
(74) *Attorney, Agent, or Firm* — Greer, Burns & Crain, Ltd.

(57) ABSTRACT

A drilling apparatus including a hydraulically powered hammer having a piston to impact a drill bit; a shuttle valve to control reciprocation of the piston; and an accumulator for hydraulic fluid; at least one drill rod having a first connection valve for connection of the drill rod to the connection valve of the hammer; and a second connection valve for connection of the drill rod to the first connection valve of a like drill rod or to a rotation device. The piston and shuttle valve are positioned substantially in-line to the axis of movement of the hammer. The accumulator is positioned proximate to the shuttle valve; and the first connection valve, and second connection valve having at least one poppet valve positioned proximate to a corresponding valve seat.

16 Claims, 14 Drawing Sheets

DRILLING APPARATUS

PRIORITY CLAIM

This application is a continuation-in-part application of PCT Application No. PCT/NZ2009/000197, filed on Sep. 17, 2009.

STATEMENT OF CORRESPONDING APPLICATIONS

The present invention is based on the provisional specification filed in relation to Australian Patent Application No. 2008904823, the entire contents of which are incorporated herein.

TECHNICAL FIELD

This invention relates to a drilling apparatus. More particularly, this invention relates to a hydraulic "down-the-hole" (DTH) percussion drilling apparatus for drilling holes in a terrain.

BACKGROUND ART

Traditionally drilling holes into and through high strength rock types has been most economically performed by percussive drilling systems. These systems fall into one of two categories; either those where the percussion mechanism is located out of the hole (top hammer systems), or those where the percussion mechanism is located in the hole (DTH systems). Top hammer systems require the use of a string of percussion drill rods to transmit force to the rock face. The transmission of percussion shock waves through a series of rods creates limitations as to hole depth and/or drilling accuracy, especially in larger hole sizes, as well as reliability issues. DTH drilling solves the problems associated with top hammer systems by creating the percussion shock waves at the bottom of the hole, where they act directly on the drill 'bit' in contact with the rock. Such DTH systems have traditionally been pneumatically powered, using compressed air to transmit energy through the drill rods down the hole to the percussion mechanism at the bottom. Such drilling systems are typically energy inefficient and slow compared to hydraulic top hammer drill systems, especially in smaller hole sizes and/or shallow depths. In an effort to combine the advantages of both top hammer and DTH drilling systems water powered DTH systems have been developed. However these systems have not found widespread use as they suffer from reliability and economic constraints, by using a non-lubricating and potentially corrosive medium (i.e. water) to transmit energy to the percussion mechanism.

EP0233038 and U.S. Pat. No. 5,092,411 disclose the concept of an oil powered DTH drill system. Both of these disclosed drill systems make use of hydraulic hammers fed by external hydraulic hoses clipped into the sides of dedicated drill rods. While the use of an oil powered hammer improves the energy efficiency and reliability of drilling, the arrangements disclosed in these documents suffer from the disadvantage that the external hoses are prone to damage when the hammer is in operation down a hole with resulting unreliability and reduced efficiency in terms of loss of oil and increased operational costs. Operational efficiency is also adversely affected by the complication of reattaching the hydraulic hoses when adding and removing drill rods.

A further source of oil loss with known oil powered drill systems, such as those disclosed in U.S. Pat. No. 5,375,670 and WO96086332, is during coupling and uncoupling of the rods supplying oil under pressure to, and receiving return oil from, the hammer during travel into and out of the drilled hole.

Further loss in efficiency of known hydraulic drill systems, such as that disclosed in JP06313391, can be due to a reduction in impact energy produced and/or reduced cycle speed where the hydraulic accumulator, used to accommodate the varying flow requirements during a cycle of piston extension and retraction, is mounted remotely from the hammer.

A further disadvantage with known hydraulic drill systems is that they are expensive to manufacture and replace when damaged due to the one-piece design of the hammer.

It is an object of the present invention to address the foregoing problems or at least to provide the public with a useful choice.

Further aspects and advantages of the present invention will become apparent from the ensuing description which is given by way of example only.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein; this reference does not constitute an admission that any of these documents form part of the common general knowledge in the art, in Australia or in any other country.

It is acknowledged that the term 'comprising' may, under varying jurisdictions, be attributed with either an exclusive or an inclusive meaning. For the purpose of this specification, and unless otherwise noted, the term 'comprising' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

SUMMARY OF THE INVENTION

According to a first aspect of the present invention there is provided a drilling apparatus comprising:

- a hydraulically powered hammer comprising:
  - a piston to impact a drill bit;
  - a shuttle valve to control reciprocation of the piston; and
  - an accumulator for hydraulic fluid;
- at least one drill rod comprising:
  - a first connection valve for connection of the drill rod to the connection valve of the hammer; and
  - a second connection valve for connection of the drill rod to the first connection valve of a like drill rod or to a rotation device wherein

- the piston and shuttle valve are positioned substantially in-line to the axis of movement of the hammer;
- the accumulator is positioned proximate to the shuttle valve; and
- the first connection valve and second connection valve comprise at least one poppet valve positioned proximate to a corresponding valve seat.

It is acknowledged for the purposes of the specification that the term "shuttle valve" means a control valve in fluid communication with hydraulic fluid and used to operate an actuating unit.

Preferably, the drill bit, piston, shuttle valve, accumulator and connection valves are connected substantially in-line to one another.

More preferably, the drill bit, piston, shuttle valve, accumulator and connection valves are modular units connected to one another via locating apertures and locking pins.

Preferably, the first connection valve and second connection valve are individually replaceable.

Preferably, the first connection valve and second connection valve comprise a first connection valve seal and a second connection valve seal respectively which are configured to minimise hydraulic fluid loss during connection and disconnection of each drill rod.

More preferably, the first connection valve and second connection valve are configured so that axial movement of the first connection valve seal and second connection valve seal is less than 20% of the drill rod diameter.

More preferably, the first connection valve and second connection valve are configured so that lateral movement of the first connection valve seal and second connection valve seal is less than 20% of the drill rod diameter.

Preferably, the drill rod also comprises:

- a pressure line for supply of pressurised hydraulic fluid from an external reservoir to the shuttle valve;
- a return line to supply return hydraulic fluid from the shuttle valve back to the external reservoir; and
- a flushing line for supply of pressurised flushing medium to the drill bit.

Preferably, the return line is an annulus arranged around the pressure line.

Preferably, the flushing line is an annulus arranged around the return line.

Preferably, the pressure line and return line are individually free floating within each drill rod.

Preferably, the pressure line and return line are individually replaceable within each drill rod.

Preferably, the first connection valve and second connection valve are configured to allow for one way flow of return hydraulic fluid away from the hammer.

Preferably, the flushing medium is air.

Preferably, the hammer also comprises an external housing which is adapted to be reversibly fitted to the hammer.

According to another aspect of the present invention there is provided a method of using a drilling apparatus, said method comprising the steps:

- assembling a hydraulically powered hammer from modular units, the modular units comprising:
  - a drill bit;
  - a piston;
  - a shuttle valve to control reciprocation of the piston;
  - an accumulator;
  - a first connection valve comprising at least one poppet positioned proximate to a corresponding valve seat, for connection of the drill rod to the connection valve of the hammer; and
  - a second connection valve comprising at least one poppet positioned proximate to a corresponding valve seat, for connection of the hammer to the first connection valve of a like drill rod or to a rotation device
- connecting at least one drill rod to the second connection valve; and
- connecting a rotation device to the second connection valve of the drill rod/s, said rotation device imparting rotational movement to the at least one drill rod and hammer.

Preferably, the method also comprises the step:

- connecting the apparatus to a hydraulic feed system adapted to move the apparatus linearly along its line of axis.

BRIEF DESCRIPTION OF DRAWINGS

Further aspects of the present invention will become apparent from the following description which is given by way of example only and with reference to the accompanying drawings in which:

FIG. 5 shows a sectional view of the rotation device of the embodiment shown in

FIG. 1;

DETAILED DESCRIPTION OF THE INVENTION

The invention is now described in relation to one preferred embodiment as shown in FIGS. 1 to 14.

For the purposes of clarity fluid interconnections between the various components of the drilling apparatus have been selectively shown in the figures.

Figure 1:
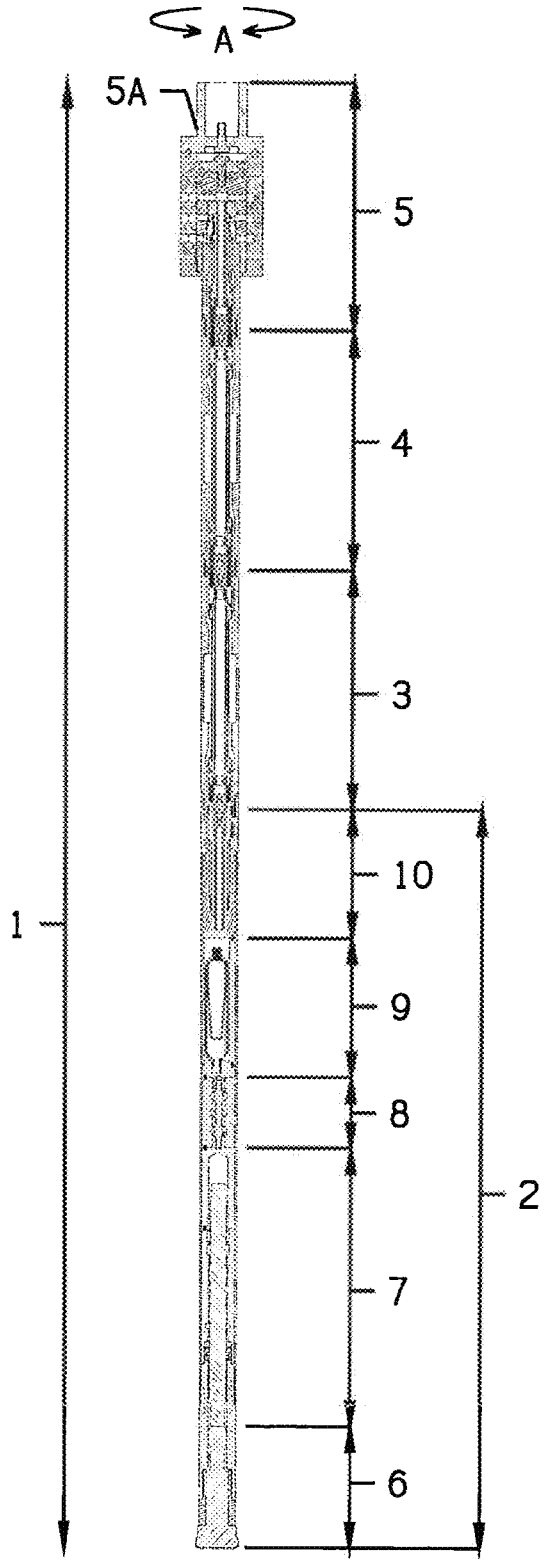
FIG. 1 shows a sectional view of a preferred embodiment of the drilling apparatus of the present invention.

FIG. 1 shows a sectional view of a preferred embodiment of a drilling apparatus generally indicated by arrow (1). The drilling apparatus (1) is a hydraulic oil powered apparatus for down-the-hole (DTH) drilling. The apparatus comprises a series of dedicated modular components which are connected in-line to one another. In this way the apparatus (1) has a low profile design to provide a minimal diameter of the hammer (2) to enable convenient operation of the apparatus (1) in confined spaces and enable a wider range of hole sizes to be drilled in a terrain.

The drilling apparatus (1) comprises a hammer (2), at least one drill rod (3, 4), and a rotation device (5). It will be appreciated by those skilled in the art that drill rods (3, 4) may be dispensed with for applications which do not require any distance between the rotation device (5) and the rod connection valve (10). Conversely, any number of drill rods may be used to extend the length of the apparatus (1) as required for a particular application. The rotation device (5) is adapted for connection to a motor and gear system (not shown) to impart rotational movement to the spindle (5A) of the rotation device (5) and the hammer (2) and drill rods (3, 4) in known fashion. The drill system (1) may be continuously rotated in both directions (i.e. clockwise or anticlockwise) by the motor and gear system as indicated by arrow A.

Figure 2:
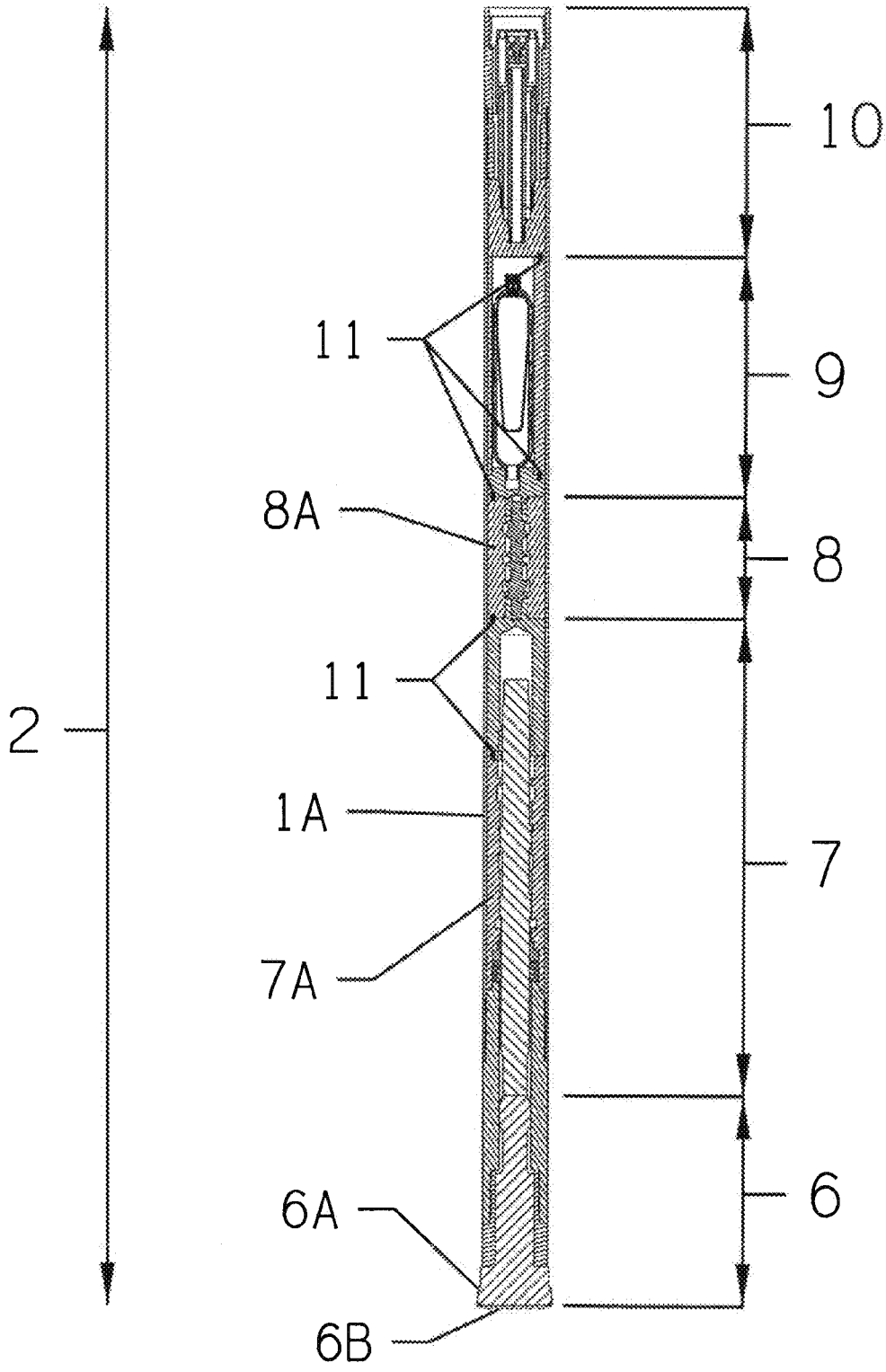
FIG. 2 shows a sectional view of the hammer of the embodiment shown in FIG. 1.

FIG. 2 shows a sectional view of a DTH hammer (2) of the drilling apparatus (1). The hammer (2) comprises a drill bit (6); a piston (7) and piston housing (7A), a shuttle valve (8) and shuttle valve housing (8A) to bias movement of the piston (7) under hydraulic fluid pressure; an accumulator (9) for hydraulic fluid such as oil, and a rod connection valve (10). All components of the hammer (2) can be connected inline to one another via locating apertures and connecting pins (11). The various flow paths within each component are connected with the corresponding flow paths of the adjacent component/s via drillings and seals at the interface of the components. The components are all housed within an external wear housing (1A). The modular nature of the hammer (2) enables reduced maintenance costs through allowing replacement of individual components rather than the whole hammer (2).

The assembled components (7 to 9) are held within the wear housing (1A) via threads at either end of the housing (1A) into which the drill bit assembly (6) and rod connection valve (10) screw. Thus these internal components (7 to 9) are held in firm contact by the force from these opposing threads at either end of the hammer (2). The housing (1A) may be turned back to front to provide prolonged service life of the hammer (2) to counteract localised erosion damage to the housing (1A) caused by drill cuttings during operation of the drilling apparatus (1).

The drill bit (6) reciprocates over a maximum range of approximately 20 mm via impacts from the piston (7). The drill bit (6) head (6A) has buttons (6B) which contact the rock and form the cutting surface. A range of drill bits of different lengths and diameters may be used to create different hole diameters suitable for different applications and terrains in known fashion.

Figure 3:
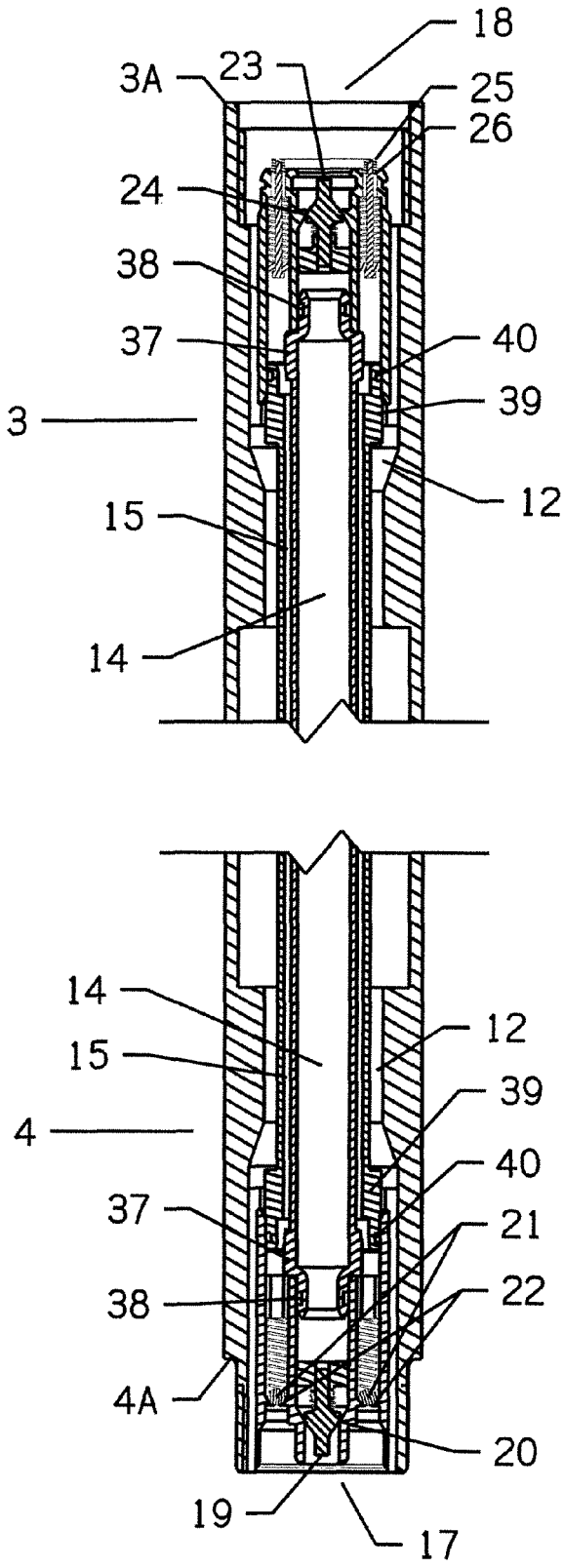
FIG. 3 shows a sectional view of the first and second connection valves of a drill rod of the embodiment shown in FIG. 1.

FIG. 3 shows a sectional view of the first (17) and second (18) connection valves of drill rods (4, 3) respectively. Each drill rod (3, 4) has an internal pipe structure to provide fluid communication from the rotation device (5) to the hammer (2) (via another drill rod if several drill rods are connected in series). Pressure oil flow path (14) carries pressure oil to the shuttle valve (8) of the hammer (2). Return oil line flow path (15) carries return oil from the shuttle valve (8) back to the rotation device (5). A flushing medium flow path (12) carries the flushing medium, usually in the form of pressurised air, to the hammer (2). It will be appreciated by those skilled in the art that other forms of pressurised flushing medium could be used without departing from the scope of the present invention such as water or carbon dioxide. The drill rods (3, 4) vary in length upwards from 1.8 metres depending on the length required for a particular application.

Figure 4:
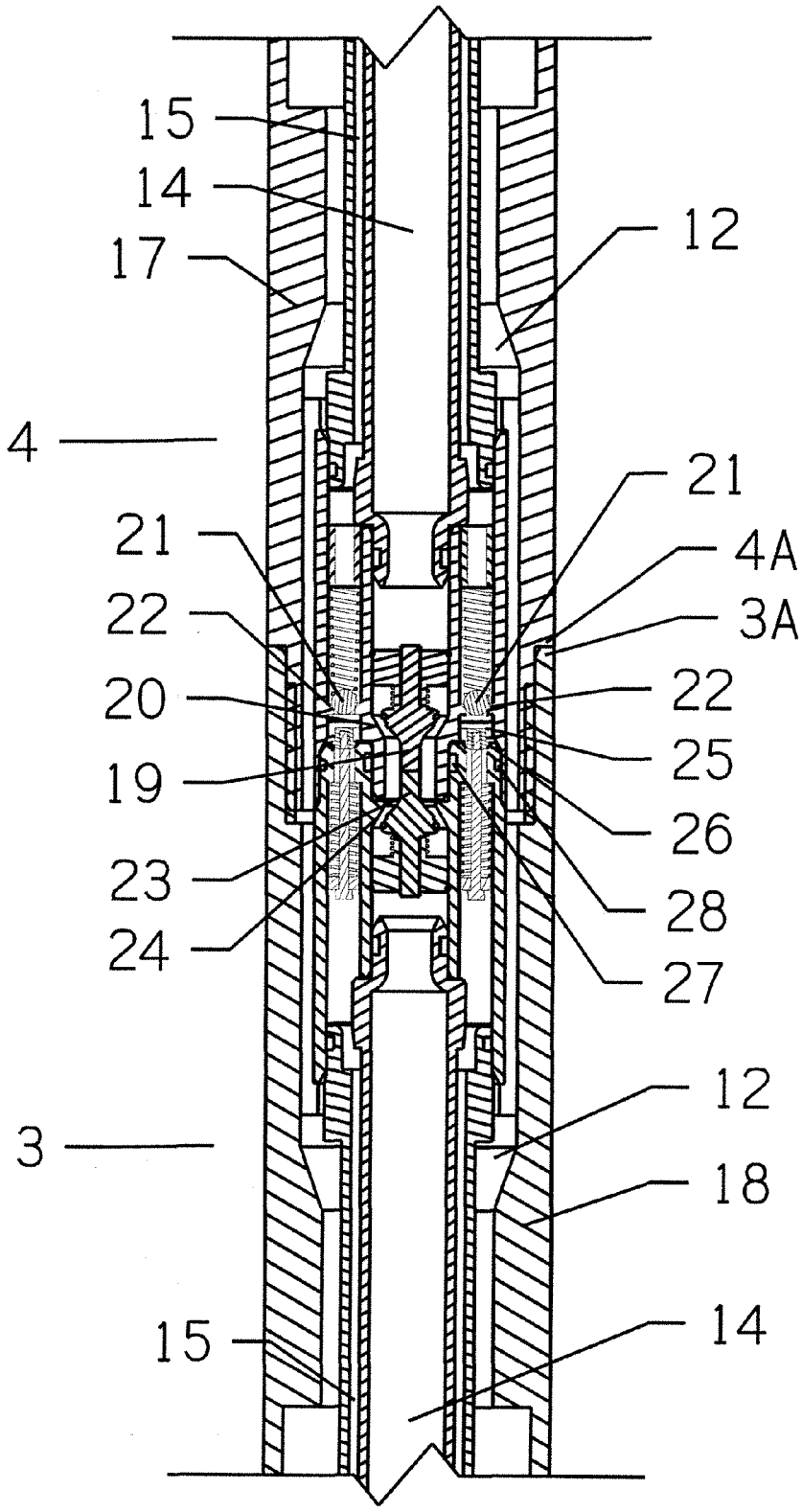
FIG. 4 shows a sectional view of two adjacent drill rods of the embodiment shown in FIG. 1 with the first and second connection valves connected.

Each drill rod (3, 4) has a first (17) and second (18) connection valve at its first and second end. First connection valve (17) has a spring loaded poppet valve (19) and seat (20) at the terminus of the pressure oil flow path (14) and spring loaded female poppet valves (21) and seats (22) at the terminus of return oil flow path (15). Similarly, connection valve (18) has a spring loaded poppet valve (23) and seat (24) at the terminus of the pressure oil flow path (14) and spring loaded male poppet valve ring (25) and seat (26) at the terminus of the return oil flow path (15). The positioning of the poppet valve's (19, 21, 23 and 25) proximal to their corresponding seats (20, 22, 24 and 26) minimises loss of oil from the drill rods when the connection valves (17, 18) are disconnected when inserting a new drill rod to extend the length of the string of drill rods down a hole or when dismantling the drill rods (3, 4). The subsequent saving in oil is very significant as this arrangement limits oil loss to only that required for thread and seal lubrication upon coupling and uncoupling, significantly saving costs and reducing environmental impact to an absolute minimum. FIG. 4 shows a sectional view of two adjacent drill rods (3, 4) with the first connection valve (17) of drill rod (4) connected to the second connection valve (18) of drill rod (3). These valves are brought together by the engaging of a male thread (not shown) on shoulder (4A) of drill rod (4) to the female thread (not shown) on shoulder (3A) of drill rod (3) and the rotation of drill rod (4) relative to drill rod (3) until the external shoulders (3A, 4A) of the two drill rods (3, 4) come into firm contact. Once these shoulders (3A, 4A) are in contact three discrete flow paths are created as follows: abutment of poppet valve (19) against poppet valve (23) causes poppet valves (19 and 23) to lift off their respective seats (20 and 24) thus connecting the pressure oil flow path (14) of drill rod (3) to the corresponding pressure oil flow path (14) of drill rod (4). Seals (27) in the groove surrounding this pressure oil flow path (14) prevent the internal leakage of oil radially into the adjacent return oil flow path (15). Another set of seals (28) in the groove surrounding the return oil flow path (15) separate the return oil flow path (15) from the flushing medium flow path (12). Ring poppet valve (25) and poppet valves (21) are biased by light spring pressure onto their respective seats (26 and 22) both in the same direction i.e. from drill rod (4) towards drill rod (3). Return oil, in flowing from drill rod (3) towards drill rod (4), will lift these two poppet valves (25, 21) off their respective seats (26, 22) with minimal restriction to flow thus connecting the return oil flow path (15) of drill rod (3) to the return oil flow path (15) of drill rod (4) for one way (return) oil flow. The flushing medium flow path (12) of both drill rods (3,4) are connected to each other by the second annulus formed between the return oil flow path (15) and the shoulders (3A, 4A) of each drill rod (3, 4).

The pressure oil flow path (14) and the return oil flow path (15) are each individually 'free floating' within each of the drill rods (3, 4) thereby allowing for thermal expansion during use. Pressure oil flow path seal carrier (37) and pressure oil flow seal (38) fitted to the ends of the pressure oil flow path (14) (as shown in FIG. 3) allows for relative movement of the pressure oil flow path (14) without pressure oil loss. Similarly, return oil flow path seal carrier (39) and return oil flow path seal (40) fitted to the ends of the return oil flow path (15) (as shown in FIG. 3) allows for relative movement of the return oil flow path (15) without return oil loss. In addition, pressure oil flow path (14) and the return oil flow path (15) and the connection valves (17, 18) are each individually replaceable enabling reduced maintenance costs through replacement of individual components rather than the whole drill rod (3, 4).

The configuration of poppet valves (19, 21, 23 and 25) allows the hydraulic connections between the flow paths (14, 15) of the respective drill rods (3, 4) to be completed with a relatively small axial engagement distance between the drill rods (3, 4) during connection. This engagement distance is typically no more than 50% of the overall drill rod diameter. As a result of this the seals (27, 28) 'sweep' over a very short distance during connection and disconnection of the drill rods (3, 4). This seal engagement distance is typically no more than 20% of the overall rod diameter. This feature minimises wear and tear of the connection valves (17, 18) and seals (27, 28) during connection and disconnection of the components of the apparatus (1). Furthermore, there are no ports or other discontinuities on the sealing surfaces and consequently the seals (27, 28) only 'sweep' over smooth, appropriately contoured surfaces during connection and disconnection further enhancing their reliability.

Figure 5:
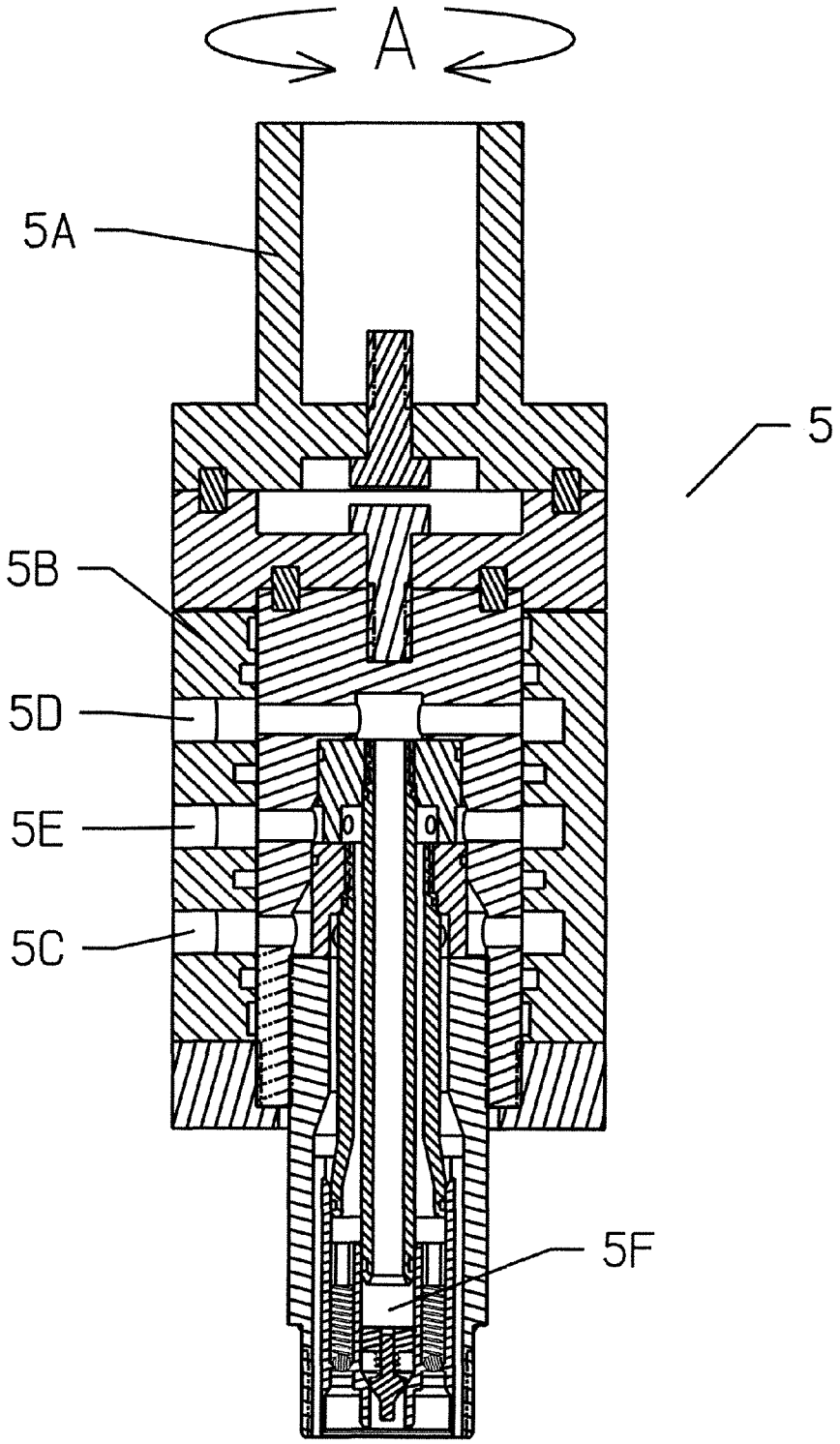

FIG. 5 shows a close-up sectional view of the rotation device (5). The swivel portion (5A) connects to a motor and gear system at arrow A which imparts rotational torque to the swivel portion (5A) and connected drill rods (3, 4) and hammer (2). A series of three ports positioned on a non-rotating portion or housing (5B) of the rotation device (5), supply flushing air (port 5C), pressure oil (port 5D) and receive return oil (port 5E) from the swivel portion (5A) which is in fluid communication with the connected drill rods (3,4) and hammer (2). A poppet valve arrangement (5F) identical to the first connection valve (17) of the drill rod (3) (as described above) prevents loss of hydraulic oil when the rotation device (5) is disconnected from the drill rod (4).

Figure 6:
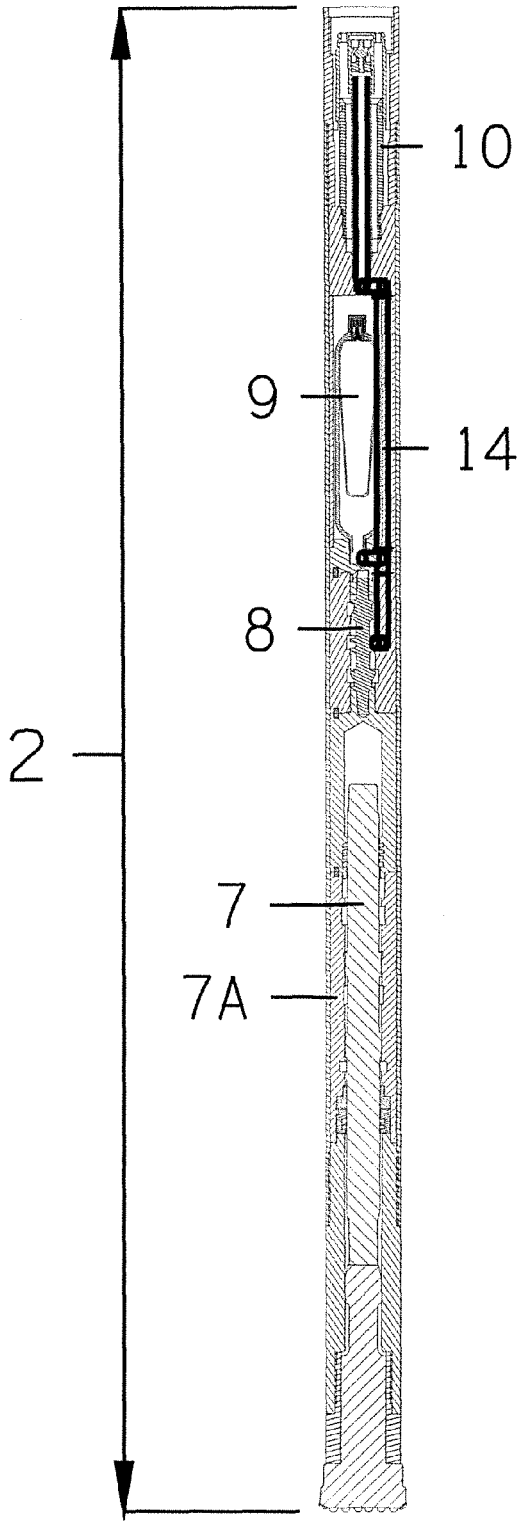
FIG. 6 shows a sectional view of the rod connection valve, accumulator and shuttle valve of the embodiment shown in FIG. 1, showing the flow path of pressure hydraulic fluid to the shuttle valve.
Figure 11:
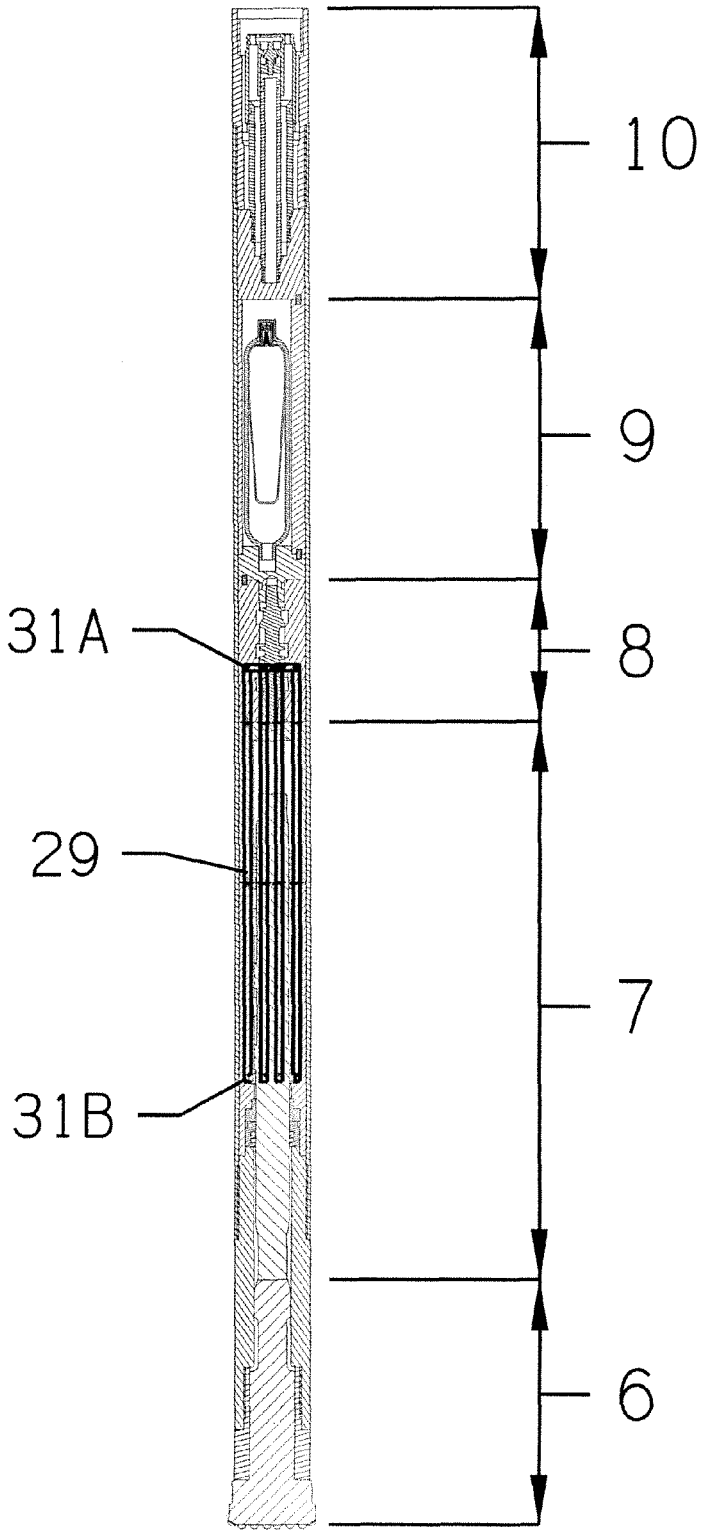
FIG. 11 shows a sectional view of the hammer of the embodiment shown in FIG. 1, showing the flow path of pressure hydraulic fluid between the shuttle valve to the piston during upward movement of the piston.
Figure 12:
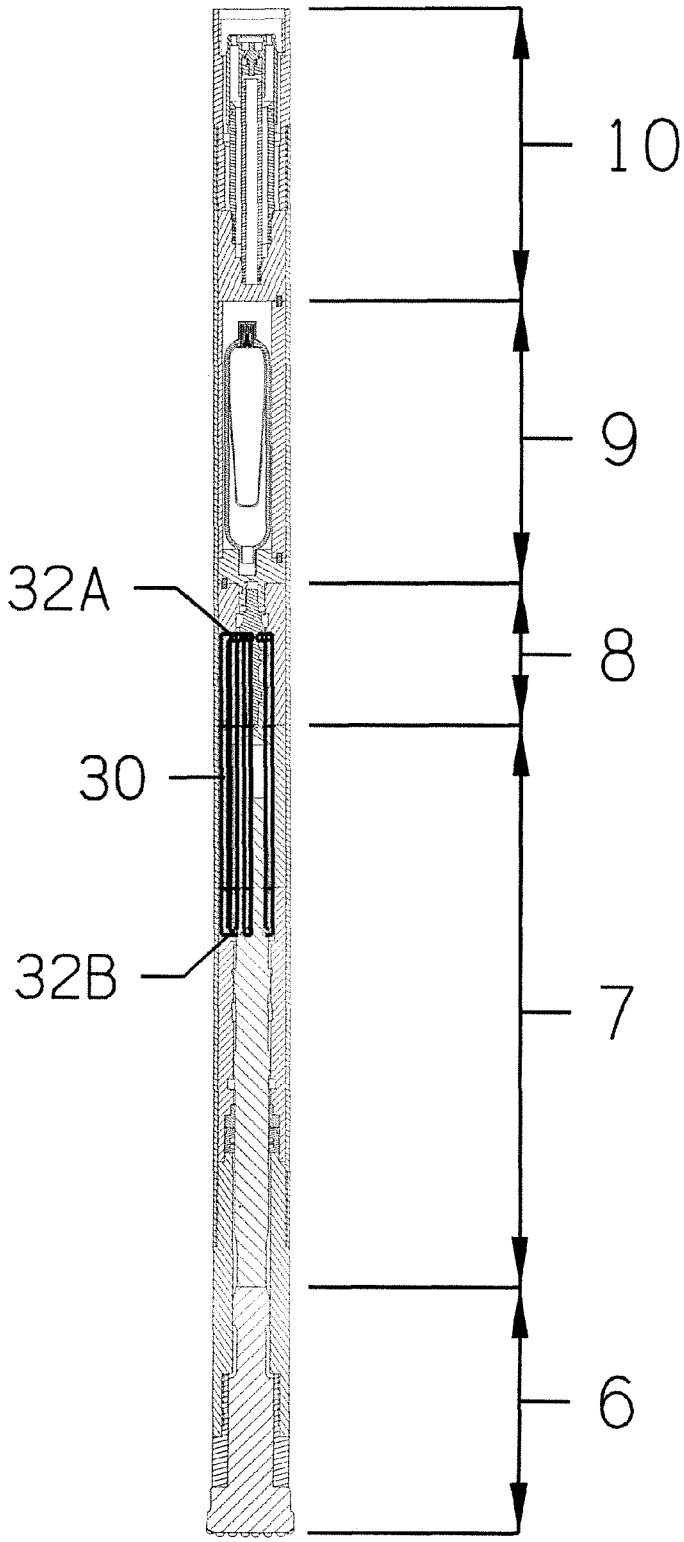
FIG. 12 shows a sectional view of the hammer of the embodiment shown in FIG. 1, showing the flow path of pressure hydraulic fluid between the shuttle valve to the piston during downward movement of the piston.
Figure 13:
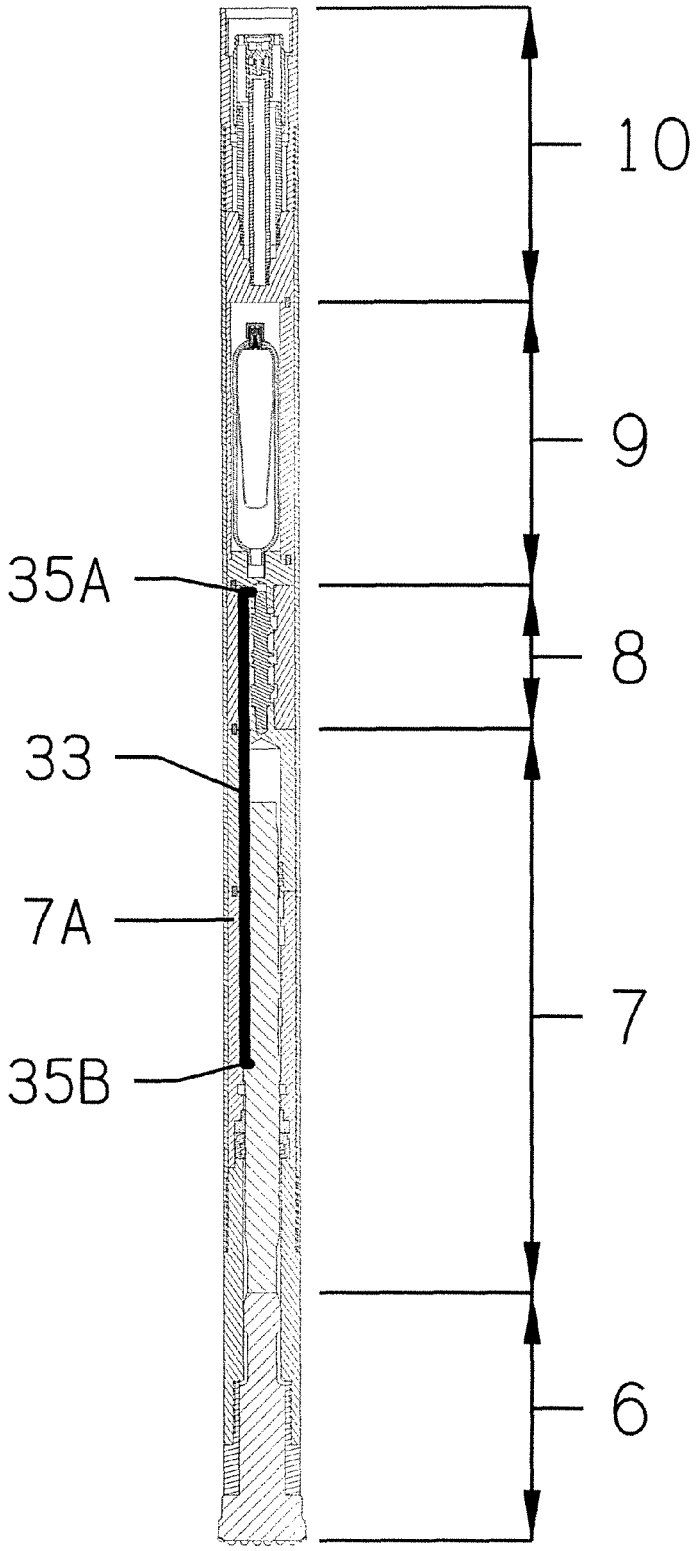
FIG. 13 shows a sectional view of the hammer of the embodiment shown in FIG. 1, showing the feedback flow path of hydraulic fluid between the piston and the shuttle valve during upward movement of the piston.
Figure 14:
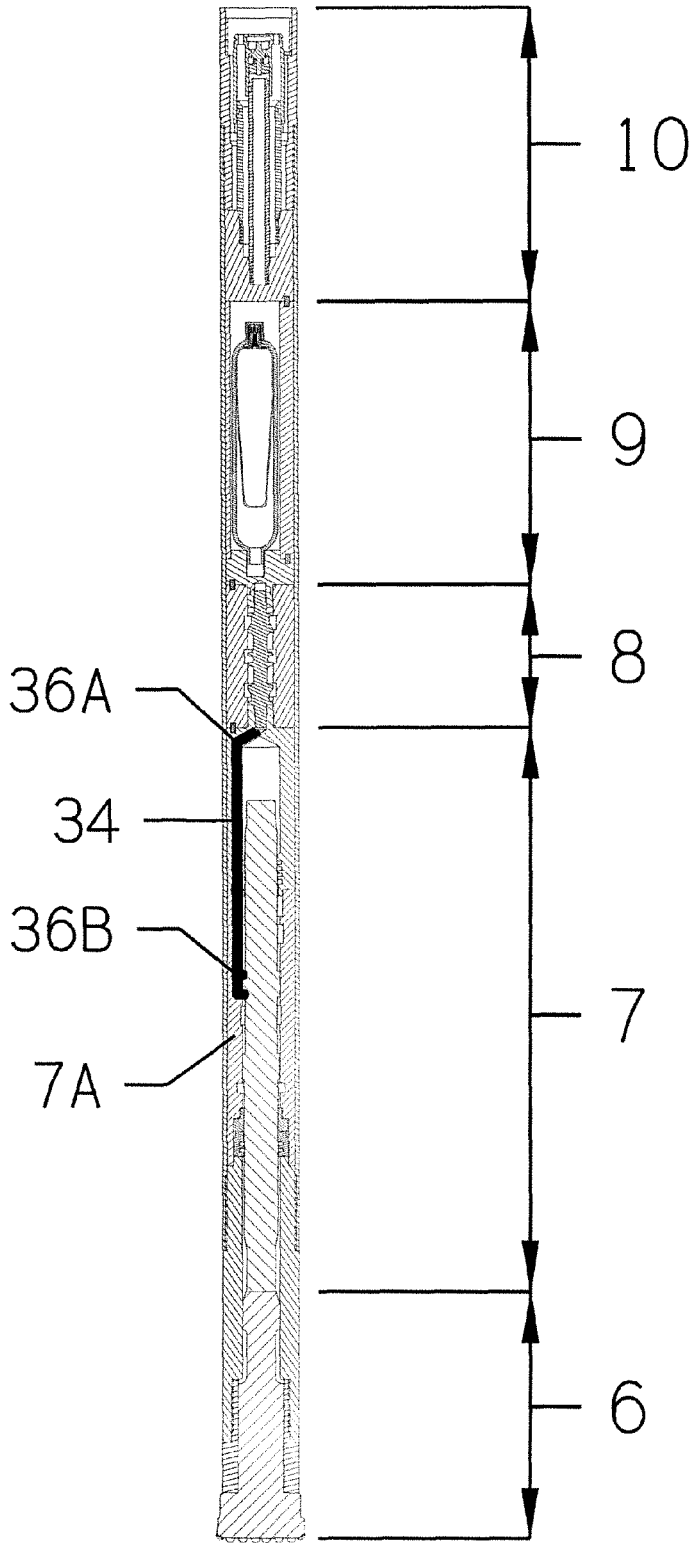
FIG. 14 shows a sectional view of the hammer of the embodiment shown in FIG. 1, showing the feedback flow path of hydraulic fluid between the piston and the shuttle valve during downward movement of the piston.

The Rod Connection Valve (10) interfaces between the three concentric flow paths of the drill rod (3) (centre=pressure oil flow path (14), first annulus=return oil flow path (15), second annulus=flushing medium flow path (12), best seen in FIG. 3) and the three side by side flow paths of the hammer (2). FIG. 6 shows pressure oil coming from the centre of the rod connection valve (10) (from drill rod (3) not shown) and on to the shuttle valve (8) via the accumulator (9). In this way changes in oil pressure to the shuttle valve (8) during operation of the drill apparatus (1) are minimised to improve efficiency and speed of drilling. The piston (7) is housed in piston housing (7A) and is in turn reciprocated by the shuttle valve (8). FIG. 11 shows the flow path (29) of pressure oil from the shuttle valve (8) to the piston (7) for the upward movement of the piston (7). Upward movement is created by pressure oil flowing out of ports (31A) in the shuttle valve housing (8A) and into ports (31B) in the piston housing (7A) to act on the bottom land of the piston (7) in known fashion. FIG. 12 shows the flow path (30) of pressure oil from the shuttle valve (8) to the piston (7) for downward movement of the piston (7). Downward movement is created by pressure oil flowing out of ports (32A) in the shuttle valve housing (8A) and into ports (32B) in the piston housing (7A) to act on the top land of the piston (7) in known fashion. Referring to FIGS. 11 and 12 the reciprocation of the piston (7) is achieved by the shuttle valve (8) alternating between these two flow conditions in known fashion. This shuttle valve (8) oscillation is controlled by position sensing ports (35B, 36B) in the piston housing (7A), as shown in FIGS. 13 and 14, which, when uncovered by the motion of the piston (7), use pressure oil 'feedback' to move the shuttle valve (8) between the two positions corresponding to downward and then upward piston (7) movement respectively. Thus the piston (7) motion is controlled over a fixed stroke length set by the location of the position sensing ports (35B, 36B shown in FIGS. 13 and 14). FIGS. 13 & 14 show the position of feedback flow paths (33, 34) from the piston (7) to the shuttle valve (8) to create downward and upward movement of the piston (7) respectively.

Figure 7:
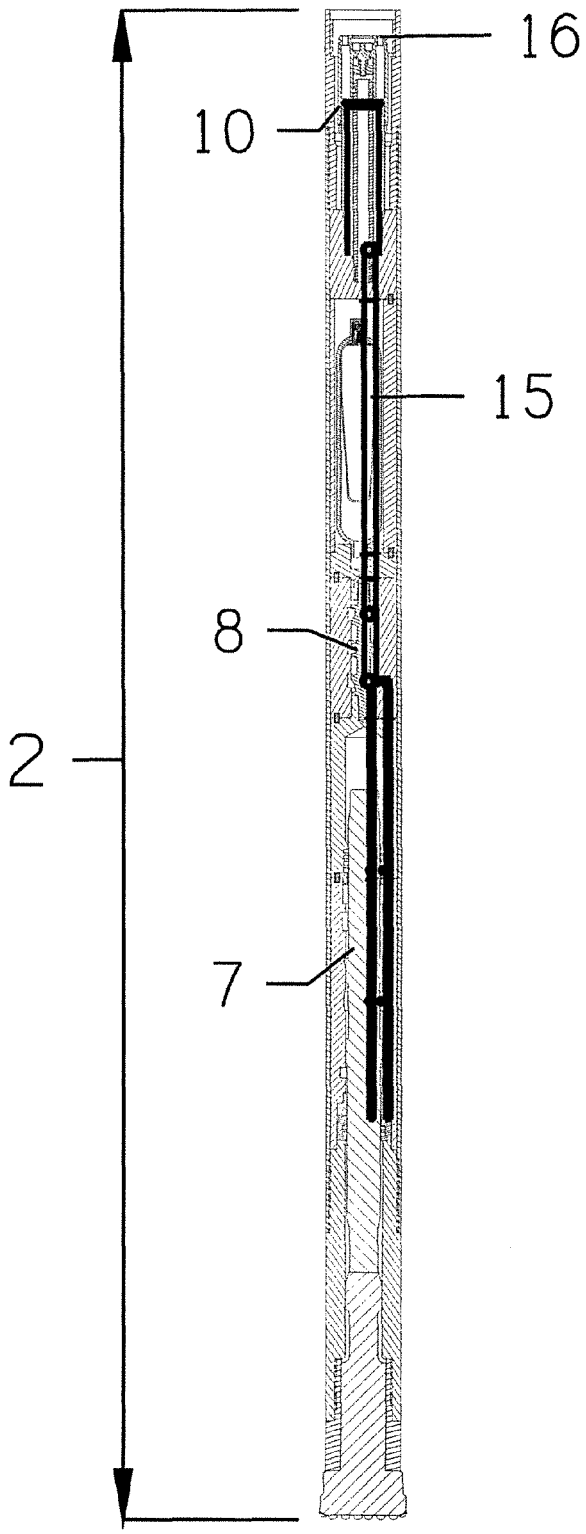
FIG. 7 shows a sectional view of the rod connection valve, accumulator and shuttle valve and other drain points within the hammer of the embodiment shown in FIG. 1, showing the flow path of return hydraulic fluid from the shuttle valve.
Figure 8:
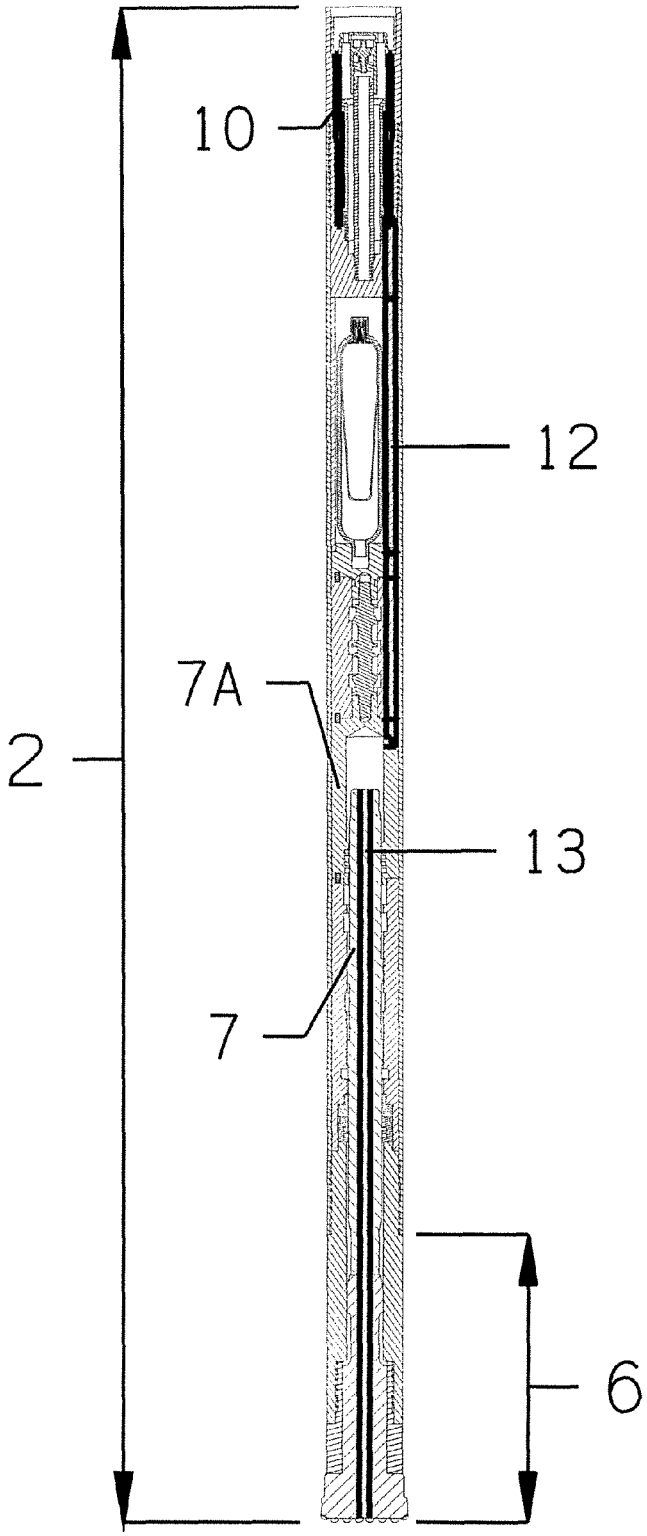
FIG. 8 shows a sectional view of the rod connection valve, accumulator, shuttle valve and piston housing of the embodiment shown in FIG. 1, showing the flow path of the flushing medium to the drill bit.
Figure 9:
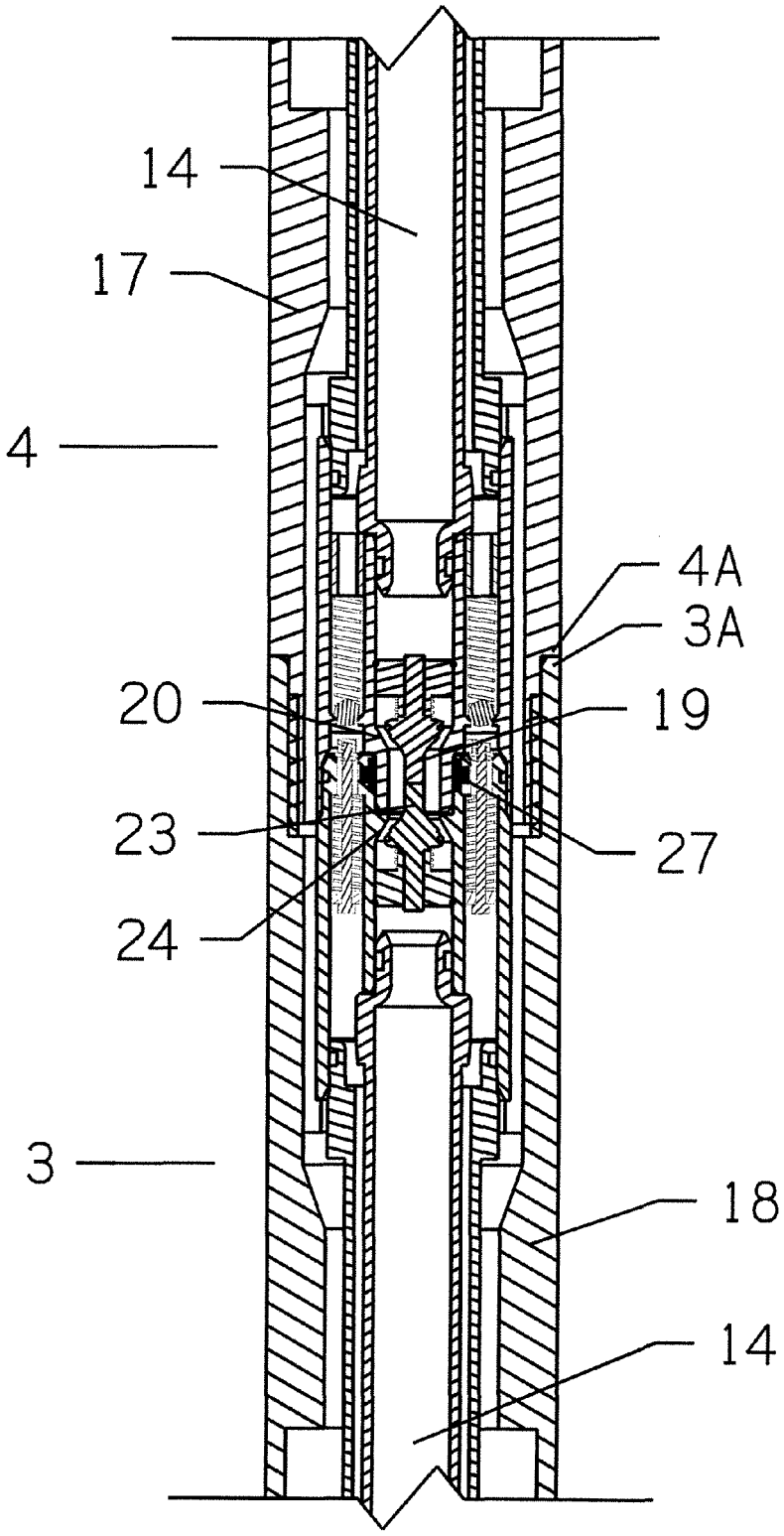
FIG. 9 shows a sectional view of two connected drill rods of the embodiment shown in FIG. 4 and the location of seals separating pressure hydraulic fluid flow path from the return hydraulic fluid flow path.
Figure 10:
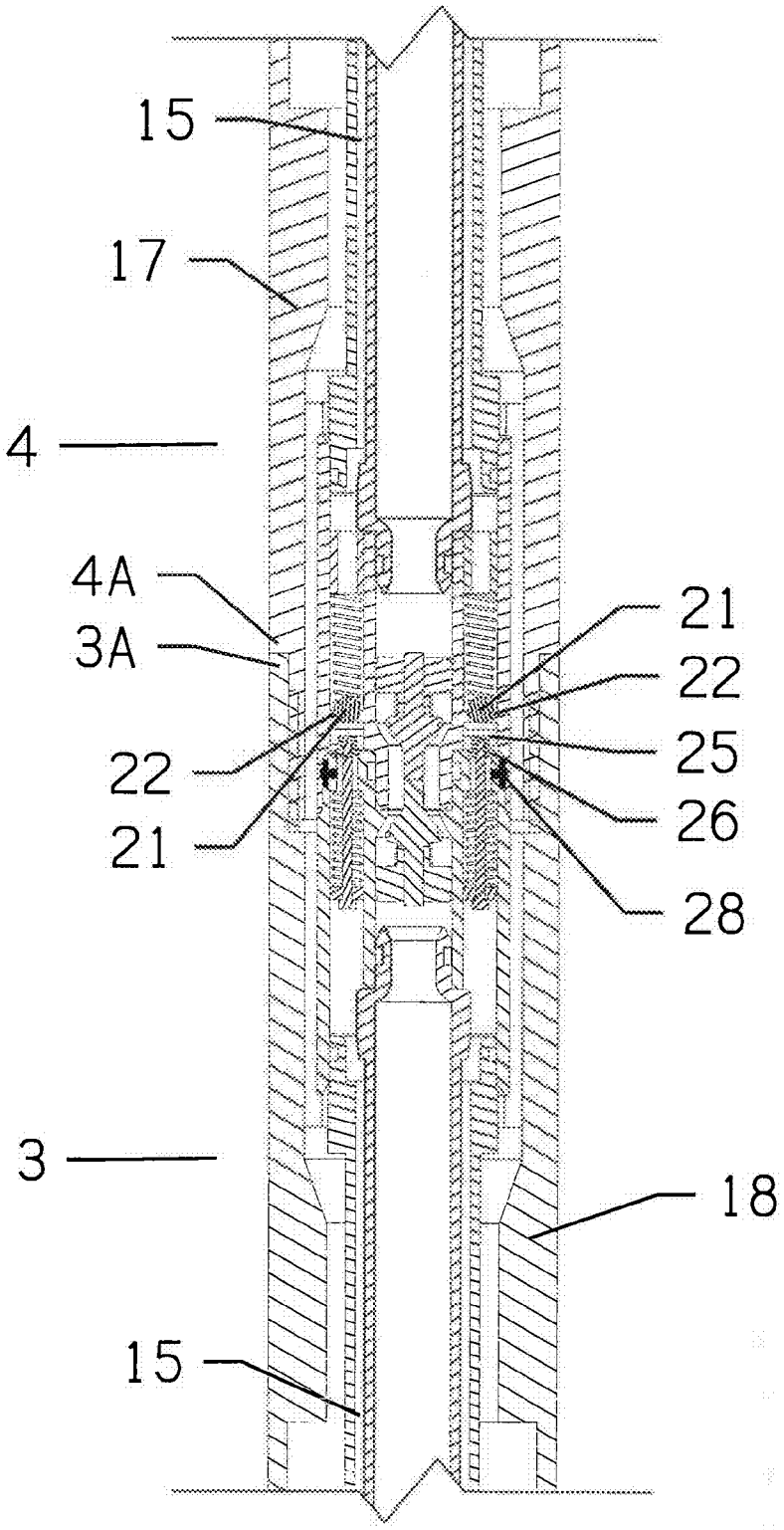
FIG. 10 shows a sectional view of two connected drill rods of the embodiment shown in FIG. 4 and the location of seals separating return hydraulic fluid flow path from the flushing medium flow path.

FIG. 7 shows the return oil flow path coming from the shuttle valve (8) and other drain points within the hammer through the rod connection valve (10) and back to the return oil flow path (15) of the drill rod (3). A poppet valve arrangement (16) identical to the second connection valve (18) of the drill rod (4) prevents hydraulic oil loss of when the hammer (2) is disconnected from the drill rod (3) (not shown). FIG. 8 shows the flushing medium path from the flushing medium flow path (12) down to the top of the piston housing (7A). The flushing medium then passes down through the piston (7) and drill bit (6) through lengthwise channels (13) in those components, coming out at the bit face to flush drill cuttings from the vicinity of the drill bit (6).

It will be appreciated by those skilled in the art that other internal arrangements of the flow paths (12, 13, 14 and 15) may be used without departing from the scope of the present invention.

In use the drilling apparatus (1) is assembled for drilling by the following method steps:

- assembling a hydraulically powered hammer (2) comprising:
  - a drill bit (6);
  - a piston (7);
  - a shuttle valve (8) to control reciprocation of the piston (7);
  - an accumulator (9); and
  - a rod connection valve (10)
- connecting at least one drill rod (3, 4) to the rod connection valve (10);
- connecting a rotation device (5) to an end of the at least one drill rod (3, 4) distal from the hammer (2);
- connecting a source of hydraulic fluid, a sink of hydraulic fluid and a source of flushing medium to the rotation device (5);
- connecting a motor and gear system to the end of the rotation device (5) distal from the hammer (2), said motor imparting rotational movement to the rotation device (5), at least one drill rod (3, 4) and hammer (2); and
- Connecting the whole apparatus to a 'feed' system capable of moving it linearly in the line of its axis. The said feed system being capable of imparting a feed or retract force of at least 20 kN.

Drilling is commenced by the bit (6B) being brought into contact with the rock face by the hydraulic feed system and hydraulic pressure of 50-200 bar (depending on terrain) being applied to port (5D) of the rotation device (5). Once penetration commences the motor and gear system (not shown) rotates the whole apparatus at 50-150 RPM (depending on hole size and terrain) and the hydraulic feed system applies a feed force of 2-20 kN (depending on terrain) advancing the apparatus into the drilled hole. Once the limit of advance has been reached drilling is stopped by removing the pressure supply from port (5D). If further advance is required the rotation device (5) may be unscrewed from the second connection valve (18) of the last drill rod, and an additional drill rod added. Drilling is then recommenced by applying the same steps as described above.

EXAMPLE 1

The apparatus (1) has been trialled by drilling 105 mm diameter holes in hard limestone at a penetration rate of over 1 m/min. Reliable drilling was demonstrated with a minimum loss of hydraulic oil.

EXAMPLE 2

Testing on prototype versions of the apparatus (1) show's that oil loss is typically as low as 0.008 litre per connection/disconnection.

Thus, preferred embodiments of the present invention may have a number of advantages over the prior art which can include:

- improved fuel efficiency through efficient energy transmission, recycling oil with minimal oil loss with resulting reduction in operational costs and reduced impact on the environment;
- improved mechanical efficiency through faster response time to changes in oil pressure during a cycle of operation with resulting faster drilling to penetrate a terrain;
- failsafe contamination protection of oil from drilling debris (cuttings);
- failsafe contamination protection of cuttings from oil (important in mineral sampling applications);
- improved wear of connection valves and seals and resulting improved reliability in connecting and disconnecting the components of the drilling apparatus;
- improved reliability through prolonged service life and consequent reduced maintenance costs as a result of modular design and reversible drill casing; and
- relative low cost of manufacture as a result of modular design.

Aspects of the present invention have been described by way of example only and it should be appreciated that modifications and additions may be made thereto without departing from the scope thereof as defined in the appended claims.

What I claim is:

1. A drilling apparatus comprising:

a hydraulically powered hammer comprising:
- a piston to impact a drill bit;
- a shuttle valve to control reciprocation of the piston;
- an accumulator for hydraulic fluid;

at least one drill rod comprising:
- a first connection valve for connection of the drill rod to a connection valve of the hammer; and
- a second connection valve for connection of the drill rod to the first connection valve of a like drill rod or to a rotation device, wherein the piston and shuttle valve are positioned substantially in-line to the axis of movement of the hammer;

the accumulator is positioned proximate to the shuttle valve; and the first connection valve and second connection valve comprise at least one poppet valve positioned proximate to a corresponding valve seat in a hydraulic fluid return line, wherein the at least one poppet valve is biased onto said corresponding valve seat to prevent reverse flow of return hydraulic fluid through the first and second connection valves while allowing for forward flow of return hydraulic fluid through the first and second connection valves.

2. The drilling apparatus as claimed in claim 1, wherein the drill bit, piston, shuttle valve, accumulator and connection valves are connected substantially in-line to one another.

3. The drilling apparatus as claimed in claim 1, wherein the drill bit, piston, shuttle valve, accumulator and connection valves are modular units connected to one another via locating apertures and locking pins.

4. The drilling apparatus as claimed in claim 1, wherein the first connection valve and second connection valve are individually replaceable.

5. The drilling apparatus as claimed in claim 1, wherein second connection valve comprises an inner connection valve seal and an outer connection valve seal respectively which are configured to prevent internal leakage of hydraulic fluid from a pressure line and a return line, respectively.

6. The drilling apparatus as claimed in claim 5, wherein the first connection valve and second connection valve are configured so that, during connection, axial movement of the first connection valve on one drill rod or on the rotation device relative to the second connection valve on another drill rod or the connection valve of the hammer is no more than 50% of the drill rod diameter.

7. The drilling apparatus as claimed in claim 5 wherein the second connection valve is configured so that, during connection, axial movement of the inner connection valve seal and the outer connection valve seal over the receiving component(s) of the first connection valve of a joined drill rod or rotation device is no more than 20% of the drill rod diameter.

8. The drilling apparatus as claimed in claim 1, wherein the drill rod also comprises:
- a pressure line for supply of pressurized hydraulic fluid from an external reservoir to the shuttle valve;
- a return line to supply return hydraulic fluid from the shuttle valve back to the external reservoir; and
- a flushing line for supply of pressurized flushing medium to the drill bit.

9. The drilling apparatus as claimed in claim 8, wherein the return line is an annulus arranged around the pressure line.

10. The drilling apparatus as claimed in claim 8, wherein the flushing line is an annulus arranged around the return line.

11. The drilling apparatus as claimed in claim 8, wherein the pressure line and return line are individually free floating within each drill rod.

12. The drilling apparatus as claimed in claim 8, wherein the pressure line and return line are individually replaceable within each drill rod.

13. The drilling apparatus as claimed in claim 8, wherein the flushing medium is air.

14. The drilling apparatus as claimed in claim 1, wherein the hammer also comprises an external housing which is adapted to be reversibly fitted to the hammer, such that either end of the housing is connectable to the hammer.

15. A method of using a drilling apparatus, said method comprising the steps:

assembling a hydraulically powered hammer from modular units, the modular units comprising:
- a drill bit;
- a piston;
- a shuttle valve to control reciprocation of the piston;
- an accumulator;
- a first connection valve comprising at least one poppet positioned proximate to a corresponding valve seat, for connection of the drill rod to a connection valve of the hammer; and
- a second connection valve comprising at least one poppet positioned proximate to a corresponding valve seat, for connection of the hammer to the first connection valve of a like drill rod or to a rotation device connecting at least one drill rod to the second connection valve; and connecting a rotation device to the second connection valve of each drill rod, said rotation device imparting rotational movement to the at least one drill rod and hammer;

wherein the first connection valve and second connection valve are configured to prevent reverse flow of return hydraulic fluid.

16. The method of using a drilling apparatus as claimed in claim 15, wherein the method also comprises the step:

connecting the apparatus to a hydraulic feed system adapted to move the apparatus linearly along its line of axis.

* * * * *